US011447987B2

(12) United States Patent
Ottolini et al.

(10) Patent No.: US 11,447,987 B2
(45) Date of Patent: Sep. 20, 2022

(54) DOOR PRESENTER WITH DOOR HOLDING PRESENTING POSITION AND ELECTRICAL RELEASE

(71) Applicant: Inteva Products France SAS, Sully sur Loire (FR)

(72) Inventors: Philippe Ottolini, La Voivre (FR); Mathias Barth, Azerailles (FR)

(73) Assignee: INTEVA FRANCE, Sully sur Loire (FR)

( * ) Notice: Subject to any disclaimer, the term of this patent is extended or adjusted under 35 U.S.C. 154(b) by 340 days.

(21) Appl. No.: 16/537,183

(22) Filed: Aug. 9, 2019

(65) Prior Publication Data

US 2020/0048939 A1 Feb. 13, 2020

Related U.S. Application Data

(60) Provisional application No. 62/717,382, filed on Aug. 10, 2018.

(51) Int. Cl.
*E05B 81/20* (2014.01)
*E05B 81/40* (2014.01)
(Continued)

(52) U.S. Cl.
CPC ..... *E05B 81/20* (2013.01); *E05B 81/16* (2013.01); *E05B 81/34* (2013.01); *E05B 81/40* (2013.01);
(Continued)

(58) Field of Classification Search
CPC ..... E05B 81/20; E05B 81/16; E05B 81/40; E05B 81/34; E05B 81/06; E05F 15/622
See application file for complete search history.

(56) References Cited

U.S. PATENT DOCUMENTS 4,597,598 A * 7/1986 Bascou ..... E05B 81/20 292/201
6,318,771 B1 * 11/2001 Holloway ..... B60K 15/05 292/201
(Continued)

FOREIGN PATENT DOCUMENTS

CN 108240146 A 7/2018
FR 2814771 A1 * 4/2002 ..... E05F 15/43

OTHER PUBLICATIONS

Chinese Office Action for Application No. 201910738554.4; dated Oct. 16, 2020.
(Continued)

*Primary Examiner* — Kristina R Fulton
*Assistant Examiner* — Emily G. Brown
(74) *Attorney, Agent, or Firm* — Cantor Colburn LLP

(57) ABSTRACT

An actuator for presenting a handless door of a vehicle. The actuator including: an extendable extension bar supporting a pawl/catch system, the pawl/catch system having an actuator catch that cooperates with a dedicated striker; an actuator housing for housing a motor and a gear train operatively coupled to the motor, the gear train comprising a gear that has an integrated wormscrew; a nut located on the integrated wormscrew that translates linearly on the wormscrew as it is rotated by the motor, wherein movement of the nut causes the extendable extension bar to be moved outwardly and inwardly from the housing.

20 Claims, 9 Drawing Sheets

(51) Int. Cl.

| | |
|---|---|
| ***E05F 15/622*** | (2015.01) |
| ***E05B 81/34*** | (2014.01) |
| ***E05B 81/16*** | (2014.01) |
| ***E05B 81/06*** | (2014.01) |

(52) U.S. Cl.
CPC ..... *E05F 15/622* (2015.01); *E05B 81/06* (2013.01); *E05Y 2900/531* (2013.01)

(56) References Cited

U.S. PATENT DOCUMENTS

| | | | | |
|---|---|---|---|---|
| 10,006,230 | B2 * | 6/2018 | Nam | E05B 81/06 |
| 10,494,851 | B2 * | 12/2019 | Dora | E05D 15/40 |
| 10,570,651 | B2 * | 2/2020 | Ueda | E05B 81/20 |
| 2018/0179788 | A1 * | 6/2018 | Oxley | E05B 81/13 |
| 2019/0292818 | A1 * | 9/2019 | Gumbo | E05B 81/14 |

OTHER PUBLICATIONS

English Translation to Chinese Office Action for Application No. 201910738554.4; dated Oct. 16, 2020.

* cited by examiner

DOOR PRESENTER WITH DOOR HOLDING PRESENTING POSITION AND ELECTRICAL RELEASE

CROSS REFERENCE TO RELATED APPLICATIONS

This application claims the benefit of U.S. Provisional Patent Application Ser. No. 62/717,382 filed on Aug. 10, 2018, the contents of which are incorporated herein by reference thereto.

BACKGROUND

Exemplary embodiments of the present disclosure pertain to the art of vehicle door latches and in particular, vehicle door latches associated with a handless door.

Handless doors require an actuator referred to as a 'door presenter', which is independent or integrated into the latch that is located inside the door. This actuator will slightly rotate/open the door, enough that an end user can insert his or her fingers to grab the door flange so that user can complete door opening manually.

However and if the car or vehicle with the handless door is parked on slope (sidewalk or other), or in case of a lot of wind, the door can open suddenly and hit the user because door opening is not controlled by the user's hand.

Accordingly, it is desirable to provide an improvement to actuators or presenters used with handless doors.

BRIEF DESCRIPTION

Disclosed herein is an actuator for presenting a handless door of a vehicle. The actuator including: an extendable extension bar supporting a pawl/catch system, the pawl/catch system having an actuator catch that cooperates with a dedicated striker; an actuator housing for housing a motor and a gear train operatively coupled to the motor, the gear train comprising a gear that has an integrated wormscrew; a nut located on the integrated wormscrew that translates linearly on the wormscrew as it is rotated by the motor, wherein movement of the nut causes the extendable extension bar to be moved outwardly and inwardly from the housing.

In addition to one or more of the features described above, or as an alternative to any of the foregoing embodiments, the extendable extension bar further includes a pawl operably secured to the nut.

In addition to one or more of the features described above, or as an alternative to any of the foregoing embodiments, the pawl is slidably secured to a pawl and catch support received within a pair of covers of the extendable extension bar.

In addition to one or more of the features described above, or as an alternative to any of the foregoing embodiments, the actuator catch is rotatably secured to the pawl and catch support.

In addition to one or more of the features described above, or as an alternative to any of the foregoing embodiments, the extendable extension bar further includes a pawl and catch spring.

In addition to one or more of the features described above, or as an alternative to any of the foregoing embodiments, the actuator further includes a retainer pivotally mounted to the nut, wherein the retainer is spring biased by a spring and wherein, when the nut is in contact with the extendable extension bar, a hook of the retainer engages a feature of the extendable extension bar.

In addition to one or more of the features described above, or as an alternative to any of the foregoing embodiments, the retainer also has a protrusion that slidably engages a declutching rib on the actuator body and wherein the protrusion engages an angled surface of the declutching rib so that the retainer can move in a direction opposite to a biasing force of the spring.

In addition to one or more of the features described above, or as an alternative to any of the foregoing embodiments, the declutching rib has a pair of angled surfaces.

Also disclosed is a handless door of a vehicle. The door including: a latch for securing the door to a striker; an actuator mounted to an inner door trim of the door, the actuator having; an extendable extension bar supporting a pawl/catch system, the pawl/catch system having an actuator catch that cooperates with a dedicated striker; an actuator housing for housing a motor and a gear train operatively coupled to the motor, the gear train comprising a gear that has an integrated wormscrew; a nut located on the integrated wormscrew that translates linearly on the wormscrew as it is rotated by the motor, wherein movement of the nut causes the extendable extension bar to be moved outwardly and inwardly from the housing and wherein outward movement of the extendable extension bar places the door in a presenting position when the latch is disengaged.

In addition to one or more of the features described above, or as an alternative to any of the foregoing embodiments, the extendable extension bar further comprises a pawl operably secured to the nut.

In addition to one or more of the features described above, or as an alternative to any of the foregoing embodiments, the pawl is slidably secured to a pawl and catch support received within a pair of covers of the extendable extension bar.

In addition to one or more of the features described above, or as an alternative to any of the foregoing embodiments, the actuator catch is rotatably secured to the pawl and catch support.

In addition to one or more of the features described above, or as an alternative to any of the foregoing embodiments, the extendable extension bar further comprises a pawl and catch spring.

In addition to one or more of the features described above, or as an alternative to any of the foregoing embodiments, the actuator further including a retainer pivotally mounted to the nut, wherein the retainer is spring biased by a spring and wherein, when the nut is in contact with the extendable extension bar, a hook of the retainer engages a feature of the extendable extension bar.

In addition to one or more of the features described above, or as an alternative to any of the foregoing embodiments, the retainer also has a protrusion that slidably engages a declutching rib on the actuator body and wherein the protrusion engages an angled surface of the declutching rib so that the retainer can move in a direction opposite to a biasing force of the spring.

In addition to one or more of the features described above, or as an alternative to any of the foregoing embodiments, the declutching rib has a pair of angled surfaces.

Also disclosed is a method for presenting a handless door. The method including the steps of: locating an extendable extension bar of an actuator on an inner door panel of a vehicle door, the actuator supporting a pawl/catch system, the pawl/catch system having an actuator catch that cooperates with a dedicated striker; extending and retracting extendable extension bar with a nut located on an integrated wormscrew of a gear train, wherein the nut translates linearly on the wormscrew as it is rotated by a motor.

In addition to one or more of the features described above, or as an alternative to any of the foregoing embodiments, the actuator further includes a retainer pivotally mounted to the nut, wherein the retainer is spring biased by a spring and wherein, when the nut is in contact with the extendable extension bar, a hook of the retainer engages a feature of the extendable extension bar.

In addition to one or more of the features described above, or as an alternative to any of the foregoing embodiments, the retainer also has a protrusion that slidably engages a declutching rib on a body of the actuator and wherein the protrusion engages an angled surface of the declutching rib so that the retainer can move in a direction opposite to a biasing force of the spring.

In addition to one or more of the features described above, or as an alternative to any of the foregoing embodiments, the declutching rib has a pair of angled surfaces.

Also disclosed is an actuator for presenting a handless door of a vehicle, the actuator including: an extendable extension bar supporting a pawl/catch system, the pawl/catch system having an actuator catch that cooperates with a dedicated striker; a motor and a gear train operatively coupled to the motor, the gear train comprising a gear that has an integrated wormscrew; a nut located on the integrated wormscrew that translates linearly on the wormscrew as it is rotated by the motor; a retainer for coupling and decoupling the nut to the extendable extension bar; and wherein movement of the nut away from the extendable extension bar when the retainer decouples the nut from the extendable extension bar releases the actuator catch from the dedicated striker when the nut moves away from the extendable extension bar.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
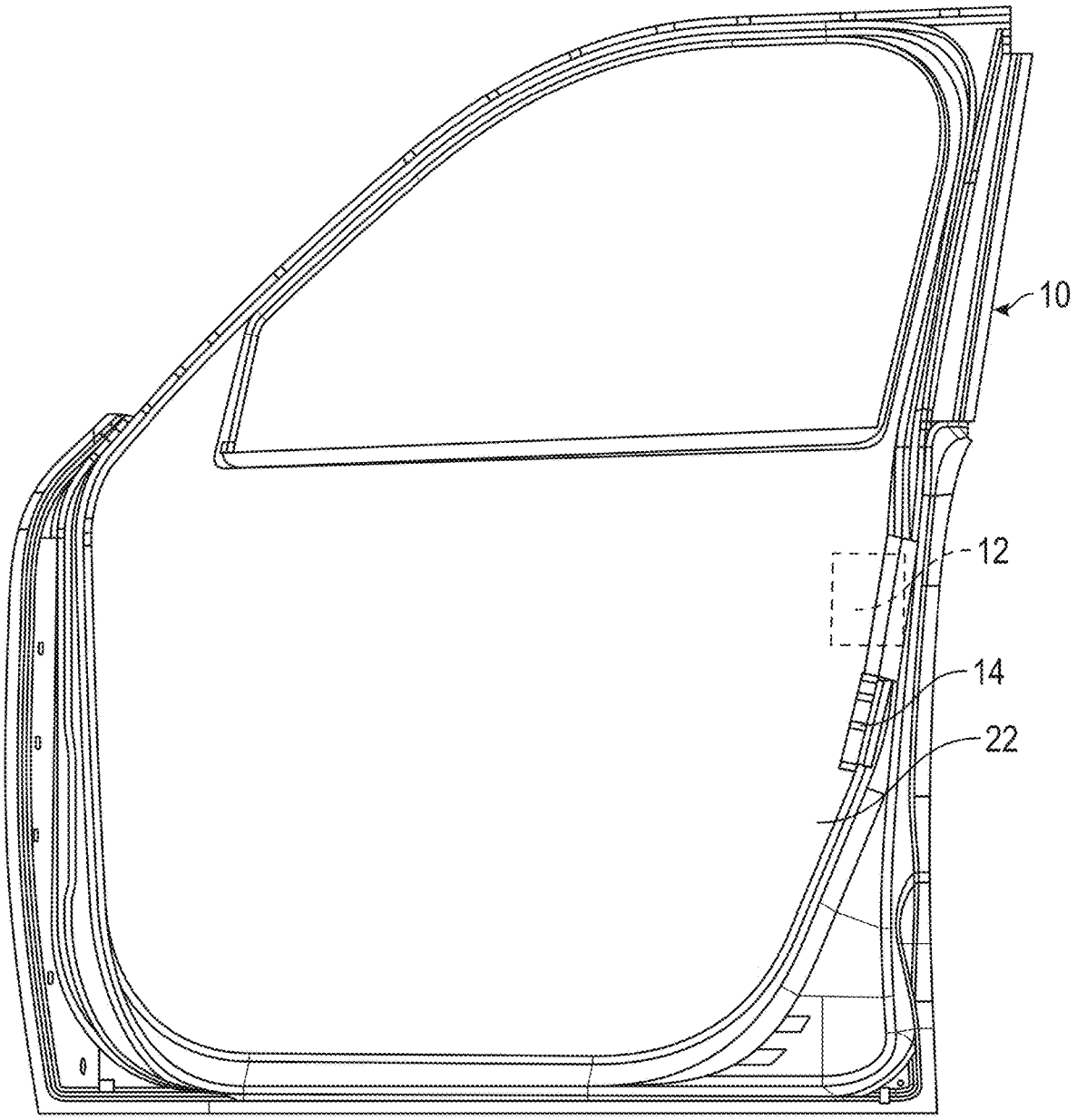
FIG. 1 is a view of a vehicle door with a latch and actuator or door presenter according to the present disclosure.

In FIG. 1, a vehicle door 10 with a latch 12 and an independent actuator or door presenter 14 is illustrated. The reference numeral 10 generally designates a vehicle door or a vehicle door assembly 10. The vehicle door 10 is a handless door and may be installed as a driver side door, passenger side door, or rear passenger doors. The vehicle door 10 may be installed as a rear door of the vehicle, such as a liftgate, trunk or tailgate, for example. A vehicle latch or vehicle latch assembly 12 is operatively coupled to the vehicle door 10 to hold the door (or liftgate, trunk, tailgate, etc.) in a closed position and to release the vehicle door to allow a user to move the vehicle door 10 to an open position. The latch 12 is an electromechanical latch assembly in some embodiments, thereby providing opening assistance to a user.

In the embodiments described herein, the vehicle door 10 does not include a door handle on the exterior of the vehicle door 10. By not including a door handle, the door 10 may be more aesthetically pleasing and/or provides an additional security measure that inhibits unauthorized access to the vehicle. A keyless entry mechanism or device is employed to initiate a door opening procedure. For example, a fob, mobile device application, keypad, or a similar keyless entry mechanism, may be utilized to actuate door opening. In particular, the latch 12 is actuated to permit door opening.

Figure 2:
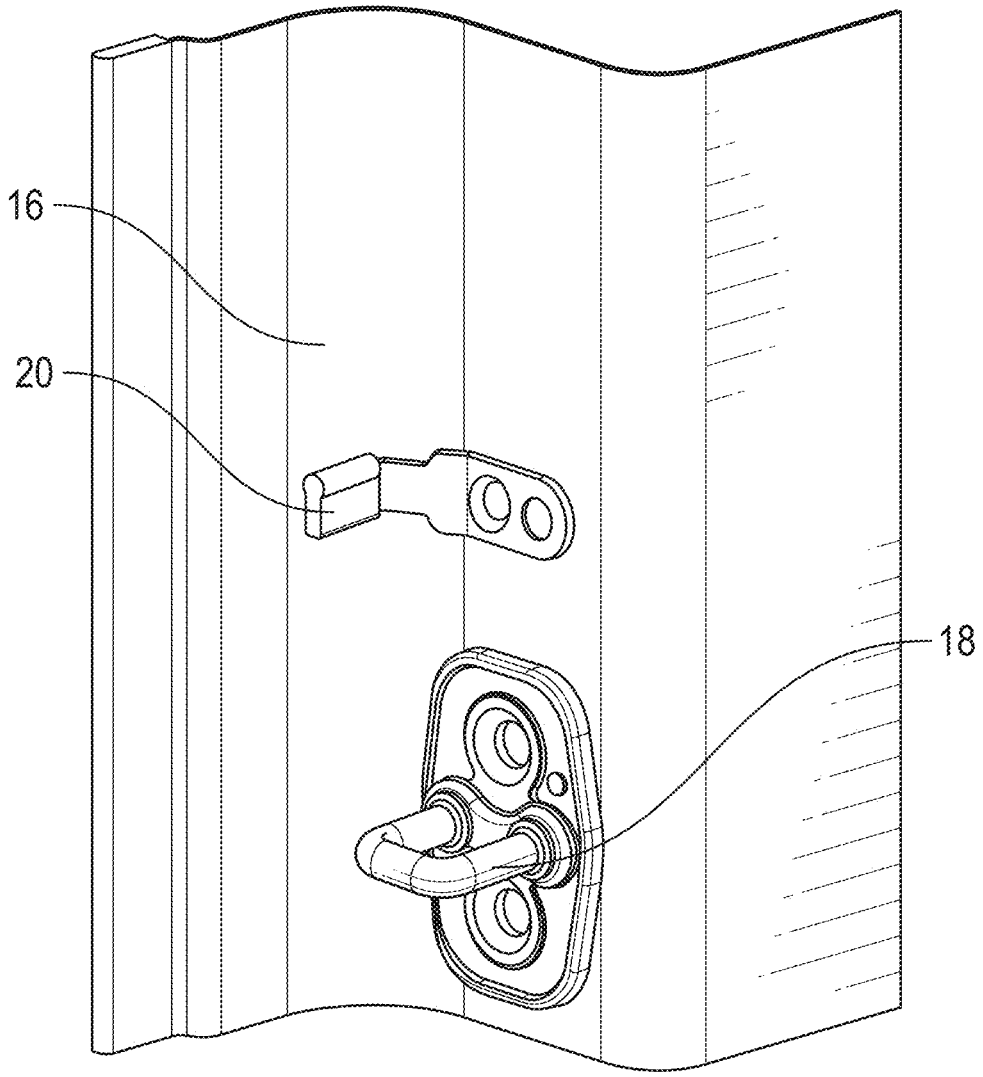
FIG. 2 is perspective view of a portion of the vehicle body according to the present disclosure.
Figure 3A:
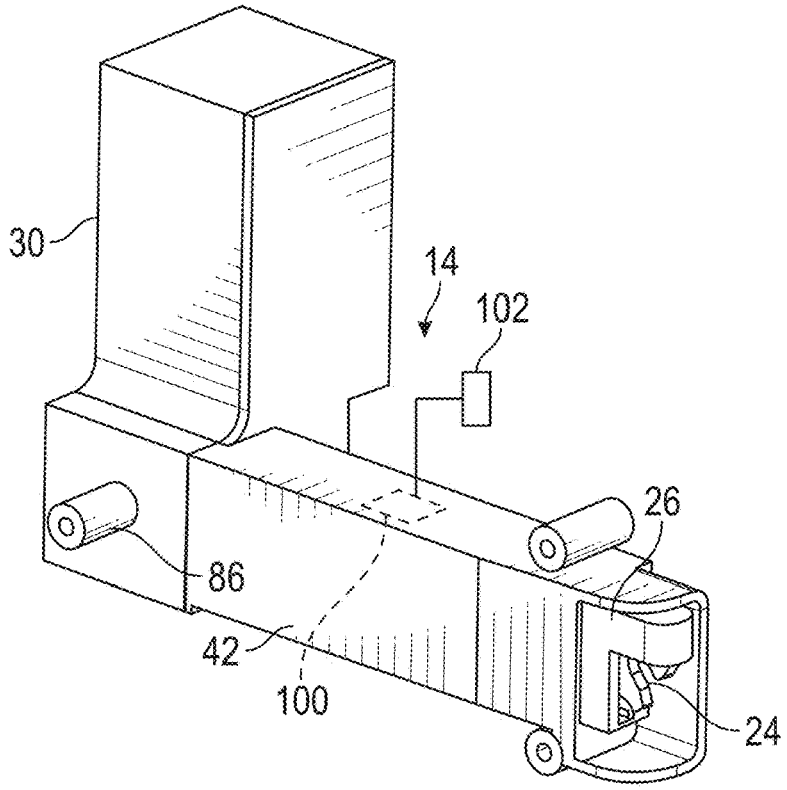
FIGS. 3A and 3B illustrate movement of the actuator or door presenter according to the present disclosure.
Figure 3B:
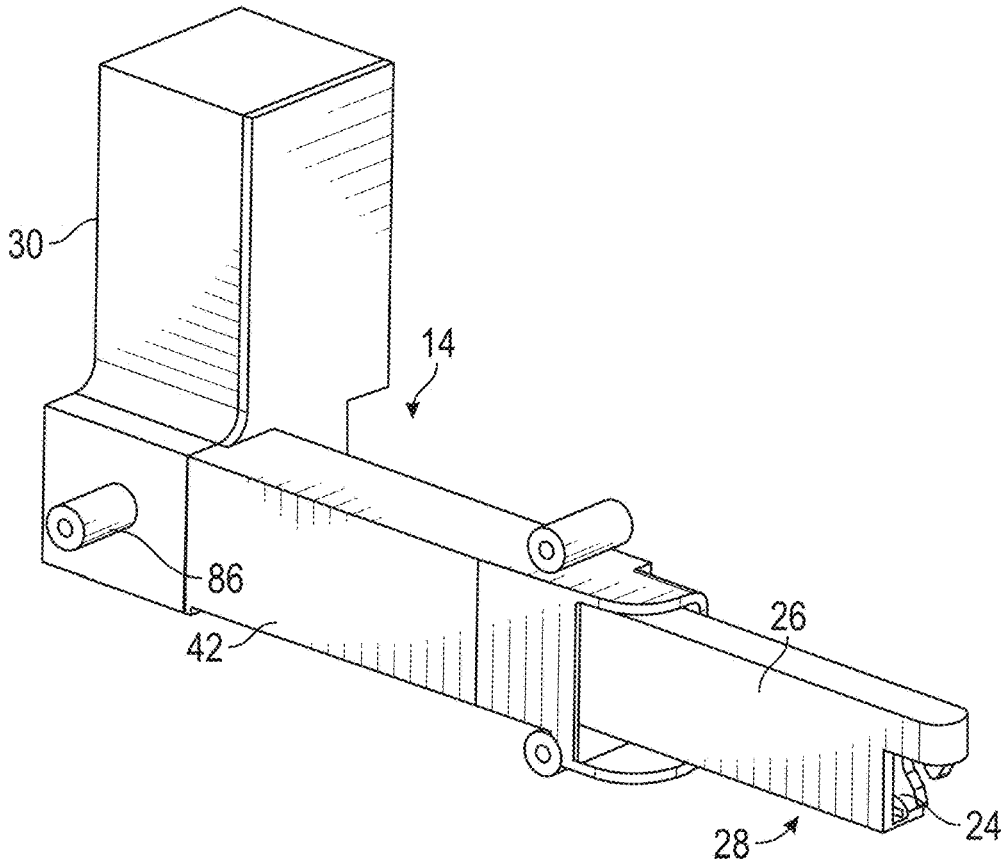
Figure 4:
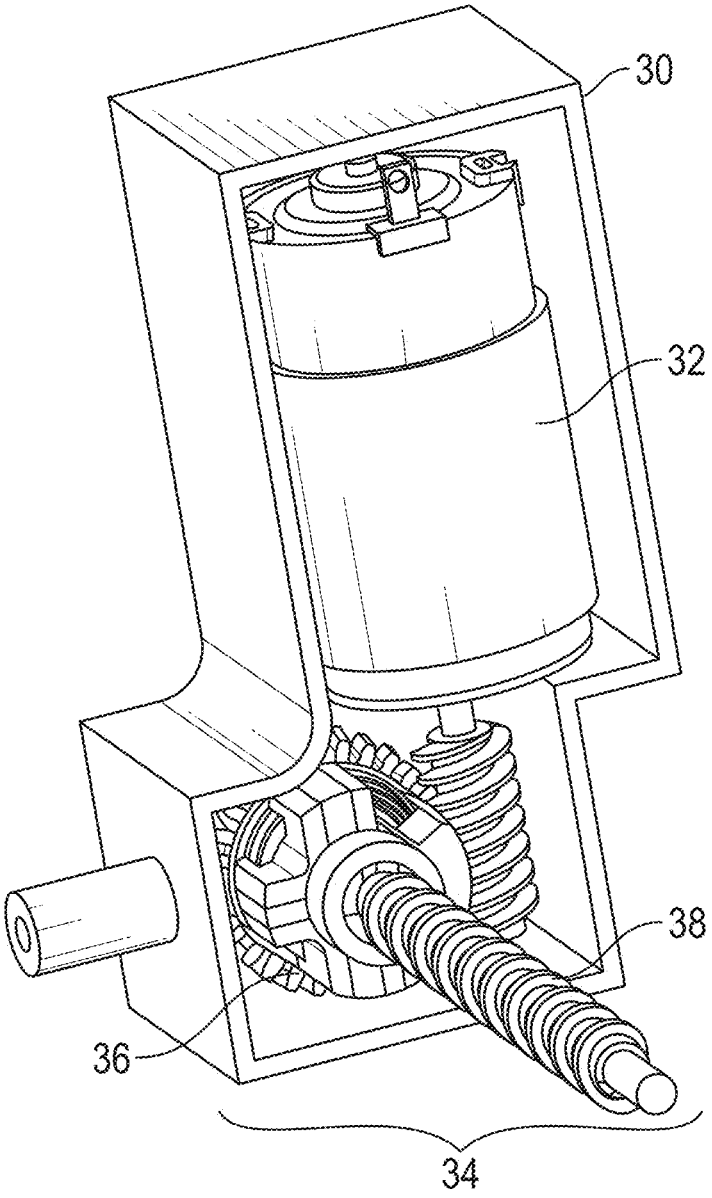
FIG. 4 is perspective view of a portion of the actuator or door presenter according to the present disclosure.
Figure 5:
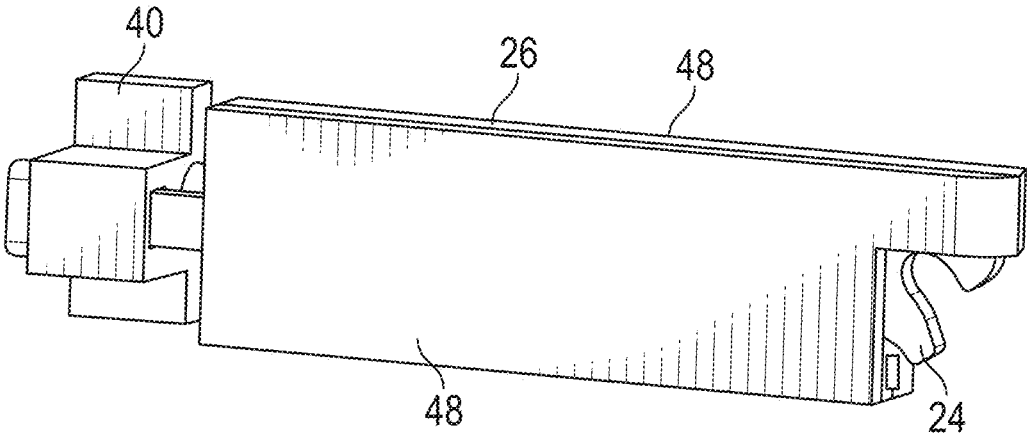
FIG. 5 is perspective view of another portion of the actuator or door presenter according to the present disclosure.

Working in conjunction with the vehicle latch assembly 12 is a door presenter 14 that is operatively coupled to the vehicle door 10. In the illustrated embodiment, the actuator or door presenter 14 is set inside the door 10, near the latch 12. In various embodiments, the actuator or door presenter 14 can be above the latch 12 or underneath the latch 12. FIG. 2 illustrates a vehicle pillar 16, which may be a B or C pillar of the vehicle. The vehicle pillar 16 is fitted with a latch striker 18 and a door presenter striker 20. Thus, the car body (B/C pillar 16), is provided with the latch striker 18 and the additional striker 20 for the actuator or door presenter 14.

As illustrated, the door presenter striker 20 is located above located above the latch striker 18, but, depending on customer/door configuration, it can be placed underneath. In one embodiment and depending type of door 10, both strikers 18, 20 may be mounted together on the same support plate. This would may allow better positioning from one versus the other for functionality purpose.

As used herein, a closed position of the vehicle door 10 refers to a completely closed position of the vehicle door 10, such that the door is not ajar from the vehicle body. A partially open position or presented position of the vehicle door 10 refers to an ajar position of the door, relative to the vehicle body, the door spaced from the vehicle body to an extent sufficient to allow a user to insert fingers between the inner panel of the vehicle door 10 and the vehicle body in a manner that permits movement of the vehicle door 10 away from the partially open position to a fully open position of the vehicle door. The fully open position refers to a position that allows a user to enter the vehicle. In some embodiments, the partially open position is defined by a space between the vehicle door 10 and the vehicle body surface 16 of less than about 50 millimeters. In some embodiments, the partially open position or presented position is defined by a space between the vehicle door 10 and the vehicle body surface 16 of between about 10 millimeters and about 40 millimeters.

In one embodiment, a hole is made on an inner door panel 22 (see at least FIG. 9) of the vehicle door 10 to allow the door presenter striker 20 to be catched by an actuator catch 24 of the actuator or door presenter 14. In one embodiment, the striker 20 is fitted on the B or C pillar 16, so that actuator 14 can push the door 10 out in presented position.

In FIG. 1, the actuator 14 is located underneath the latch 12, however, it can be placed in any other location depending on the customer/door configuration.

In FIGS. 3A-5, portions of the actuator 14 are illustrated. The actuator 14 has an extendable extension bar 26 that supports a pawl/catch system 28 comprising the actuator catch 24 that cooperates with the dedicated striker 20. The actuator 14 includes an actuator housing 30 that is configured to receive a motor 32 and a gear train 34 operatively coupled to the motor 32. The gear train 34 includes a gear 36 that has an integrated wormscrew 38. Located on the wormscrew 38 is a nut 40 that translates linearly on the wormscrew 38 as it is rotated by the motor 32.

As such, the nut 40 moves due to rotational movement of the wormscrew 38 due to rotation of gear 36 by the motor 32. As the nut 40 moves it moves the extension bar 26 out or in of an actuator cover 42 depending on the motor 32 driving direction.

Figure 6:
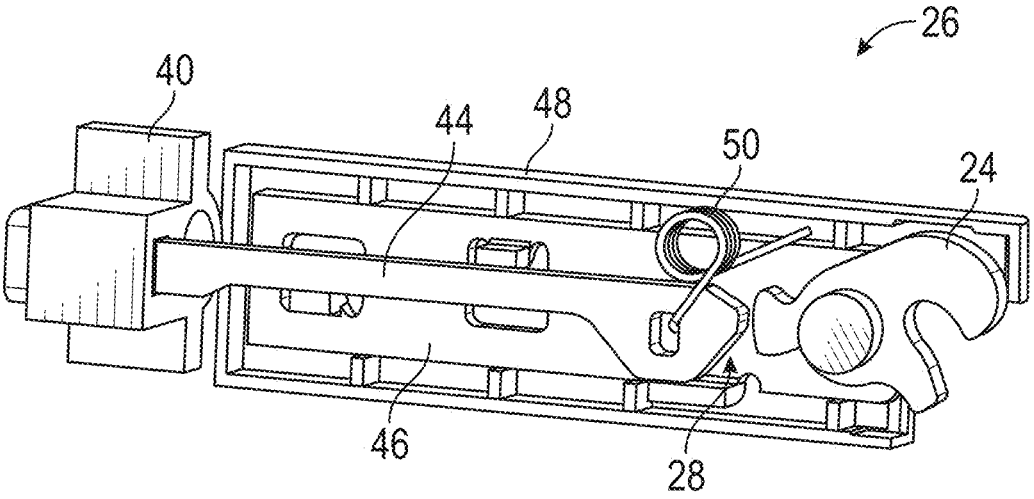
FIG. 6 is perspective view illustrating details of the actuator or door presenter according to the present disclosure.

FIG. 6 illustrates the extension bar 26 wherein the extension bar cover is removed. As illustrated, the nut 40 is secured to a pawl 44 that is slidably secured to the a pawl and catch support 46 received within a pair of covers 48 of the extension bar 26. The actuator catch 24 of the extension bar 26 is rotatably secured to the pawl and catch support 46. Also located in the extension bar 26 is a pawl and catch spring 50.

Figure 7A:
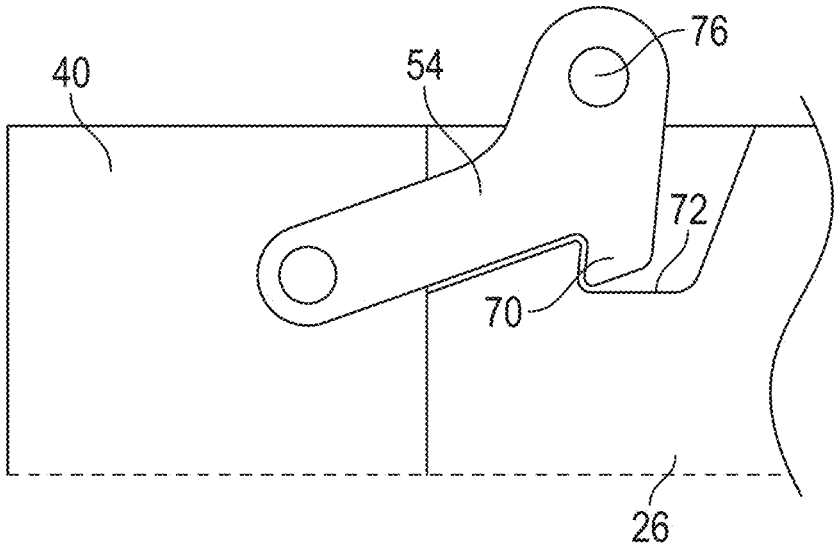
FIGS. 7A and 7B are views illustrating details of the actuator or door presenter according to the present disclosure.
Figure 7B:
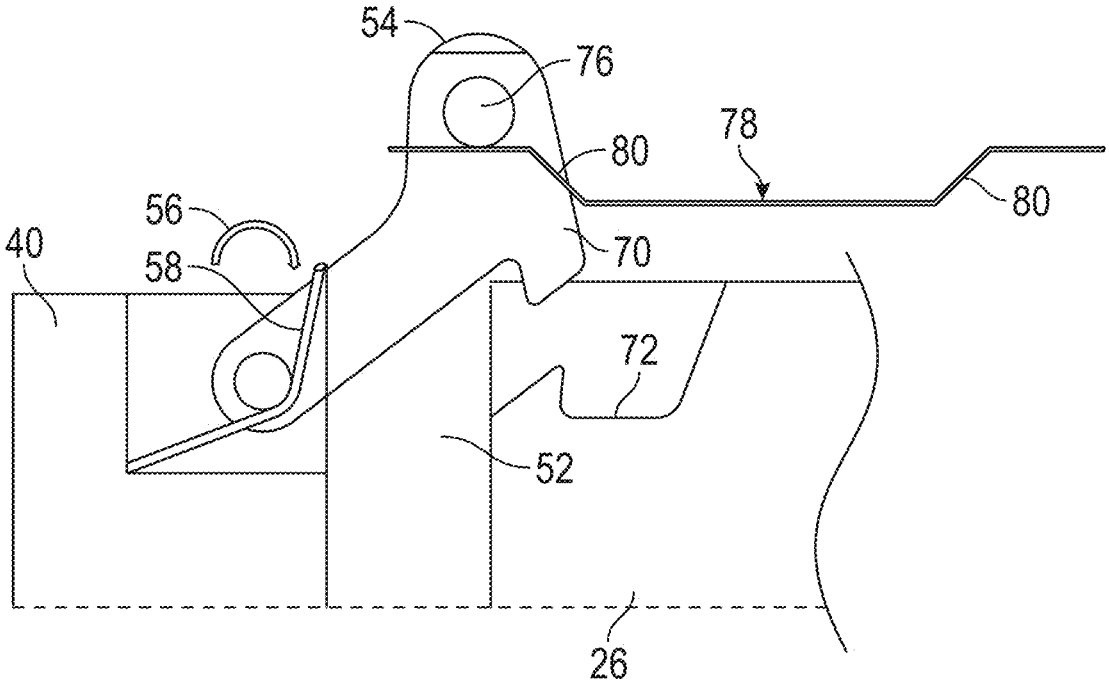

Referring now to FIGS. 7A and 7B coupling and decoupling of the nut 40 to the extension bar 26 is illustrated. As illustrated in FIG. 7B, there is a gap 52 between the nut 40 and the extension bar 26. In FIG. 7A the gap 52 is removed and the nut 40 is in contact with the extension bar. In this position a retainer 54 that is pivotally mounted to the nut 40 and is spring biased in the direction of arrow 56 by a spring 58, secures the nut 40 to the extension bar 26 when the nut 40 is in contact with the extension bar 26. This is achieved by a hook 70 of the retainer 54 that engages a feature 72 of the extension bar 26. The retainer 54 also has a protrusion 76 that slidably engages a declutching rib 78 on the actuator body or cover or housing 42. The protrusion 76 engages an angled surface 80 of the declutching rib 78 so that the retainer 54 can move in a direction opposite to arrow 56 against the biasing force of the spring 58, which causes the retainer 54 to be disengaged from the extension bar 26. As illustrated, the declutching rib 78 has a pair of angled surfaces 80 in order to facilitate this movement.

During operation of the actuator 14, there is a free space or the gap 52 between the nut 40 and the extension bar 26 when actuator 14 is in rest position. This means the nut 40 is not in contact with the extension bar 26. When the extension bar 26 is moving through movement of the nut 40 there is no gap between the nut 40 and the extension bar 26. The free space 52 means that the pawl 44 is not engaged with the catch 24 and the door 10 cannot then be held.

The retainer's function 54 is to clutch the extension bar 26 with the nut 40 when the nut 40 is in contact with the extension bar 26, so that no free space between the nut 40 and housing 48 of the extension bar 26 is possible. As mentioned above, the retainer 54 can be declutched to free the nut 40 from the extension bar 26 through a rib 78 set into the actuator body. Declutching of the nut 40 is possible at the two extreme positions of the extension bar 26, position in or out.

Since the nut 40 is linked to the pawl 44, the pawl 44 is sliding on the pawl and catch support 46 due to the movement of the nut 40. When the catch 24 comes in touch with the striker 20, the catch 24 will rotate and then the pawl 44 can be engaged.

Referring now to FIGS. 8A-8E, a sequence for operation of the door presenter 14 is illustrated and described as follows, opening requested from outside when the latch 12 is closed and the latch striker 18 engaged. This may be referred to the initial position in FIG. 8A. Note the retainer 54 is not illustrated in FIGS. 8A-8E. However, it is contemplated that the retainer 54 will be integrated with the nut 40 in one non-limiting embodiment. Here the actuator 14 is in a rest position and the extension bar 26 is stowed in the actuator cover (See at least FIG. 8A). In this position, the catch 24 is not engaged and retainer 54 declutched. As there is no outside handle, a user has asked for a door open request using a remote control or by touching a sensor set on the external door panel or somewhere on outer skin of the car.

Once the door presenting request is sent via operation of the remote control or by touching a sensor, the motor 32 is fired and the wormscrew 38 moves the nut 40 that moves the pawl 44 through its spring 50. The nut 40 moves the extension bar 26 until the catch 24 touches the striker 20 while pawl 44 is in contact with catch 24. See at least FIG. 8B.

Figure 8A:
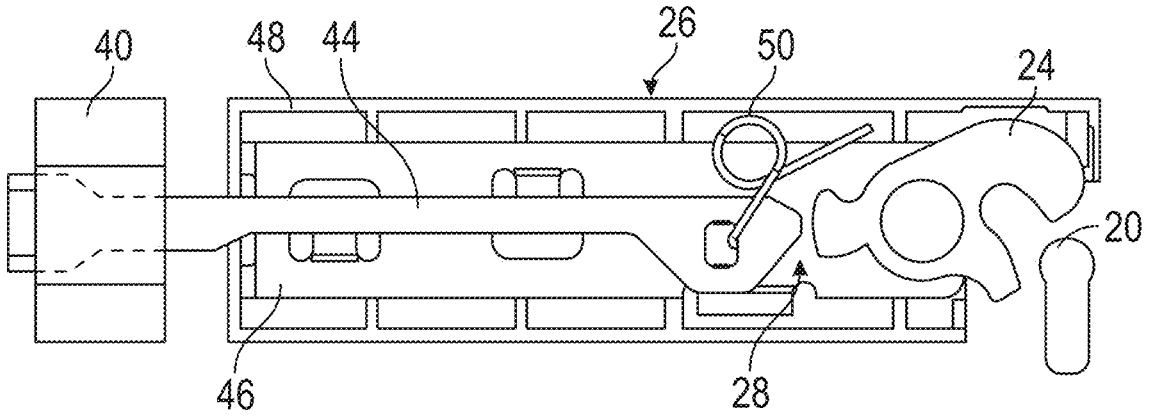
FIGS. 8A-8E are views illustrating operation of the actuator or door presenter according to the present disclosure.
Figure 8B:
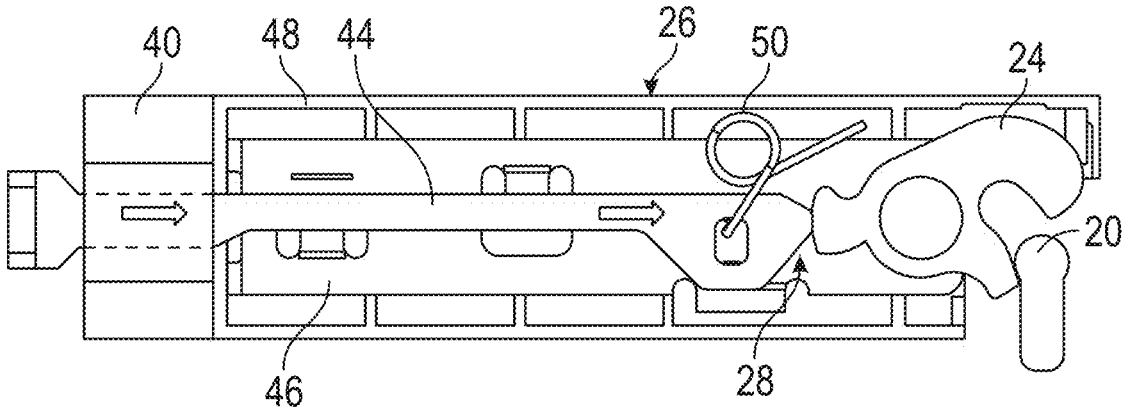
Figure 8C:
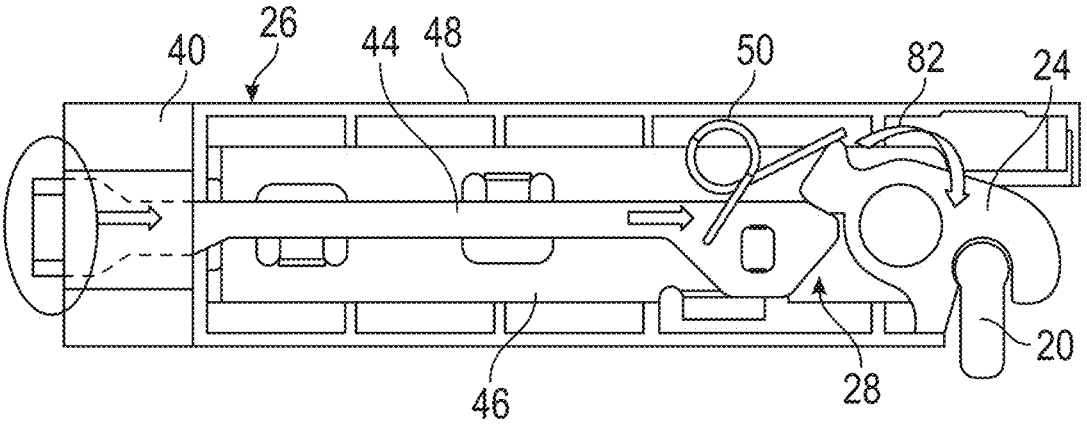

FIG. 8C illustrates a pre-required position before the latch 12 is released. Here the catch 24 has rotated in the direction of arrow 82 and the striker 20 is now engaged. The pawl 44 locks the catch 24 and the nut 40 is in contact with the extension bar 26 and keeps pushing it. At this point the latch 12 can now be released. As the motor 32 continues to be driven, the nut 40 is pushing on the extension bar 26 to push out the door 10, until the presenting position (e.g., the latch 12 is disengaged and door 10 can be opened). The extension bar 26 and the nut 40 now reach their full extended position corresponding to the door presenting position when the door 10 is open enough for a user to grab it however the catch 24 is still engaging the striker 20.

The feeding time controls the motor 32 and the motor 32 is fed longer than the needed transfer time, therefore the motor 32 will be a short time in stall torque when the system will reach the presenting position. Then the motor will stop. The same operation occurs for the reverse motion.

During the reverse motion the retainer 54 is declutched as mentioned above to allow the nut 40 to move apart from the extension bar 26.

Figure 8D:
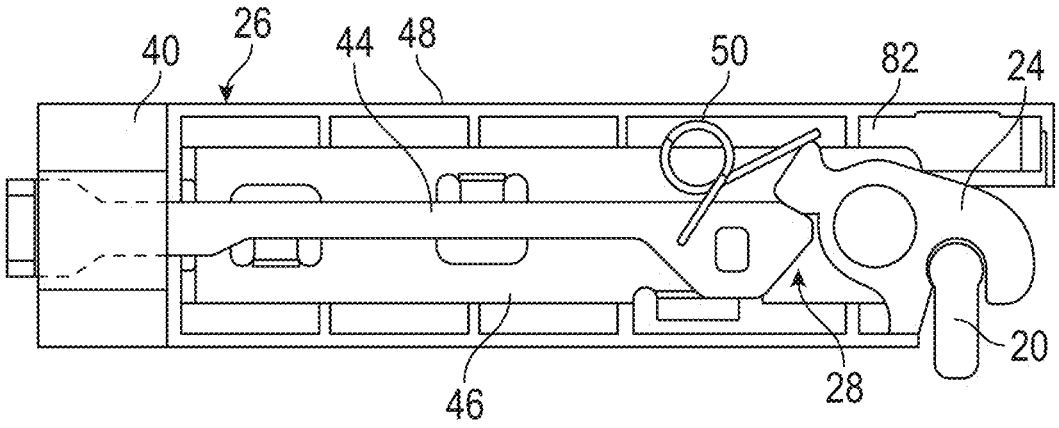
Figure 8E:
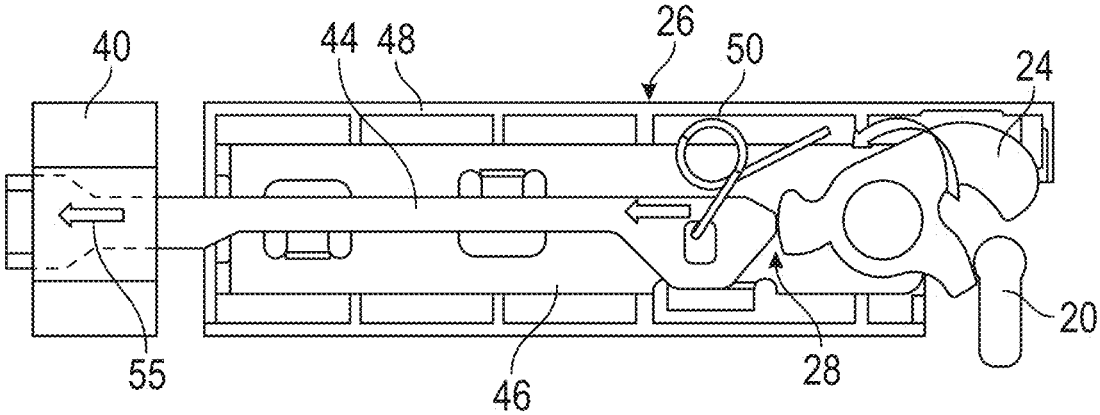

FIG. 8D illustrates the door releasing operation. Here the extension bar 26 is fully out (door 10 is in the presenting position), the pawl 44 and catch 24 are engaged. The catch holds the door in this 'presenting' position as long as the user does not grab the door edge and touch again the sensor set on the external door panel or somewhere on the outer skin of the car. As the extension bar 26 is in the extreme out position, the retainer 54 is declutched allowing the nut 40 to move appart from extension bar 26 towards the 'in' direction. See at least arrow 55 in FIG. 8E. The user will then touch again the sensor set on the external door panel or somewhere on the outer skin of the car. This will indicate to the system that the user has grab the door with his hand and that he is ready to complete the opening motion of the door. The door presenting position is sufficient for the user to insert his fingers and grab the door flange to complete manually the door opening. Therefore the motor 32 will move the nut 40 towards the 'in' direction, pulling the pawl 44 in release position that will free the catch 24 from the striker 20 and door opening can be performed by the user.

The system will then continue back to move the extension bar 26 'in' (e.g., arrow 55) until reaching the rest position see at least FIG. 8A to be ready for next presenting request. Optionally, the extension bar 26 is moved back to an "in" position in this "in" position the extension bar 26 can trigger a sensor 100 in order to provide a 'reset' position signal to a door control unit 102. This sensor can be named a 'home' sensor 100.

The system maintains a position "presenting position" of the door during the presenting motion, as well as its releasing only in particular positions. It gives the user a stable door presenting position before he will grab the door since there is no handle on the door.

Figure 9:
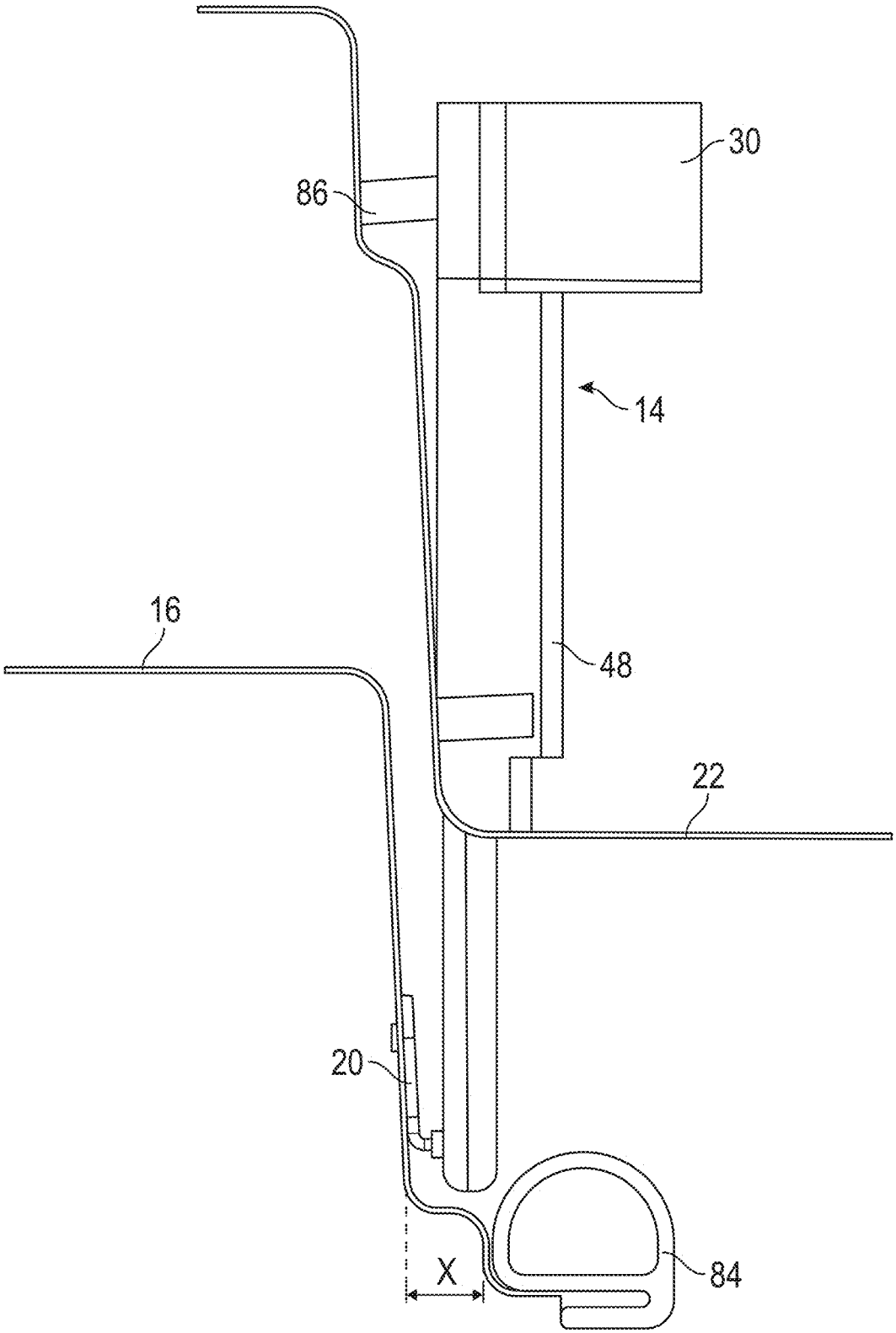
FIG. 9 is a view illustrating the actuator or door presenter secured to a portion of the vehicle door.

This is obtained through a retainer 54 that is clutching the nut 40 with the extension bar 26 during the presenting motion, and through the retainer 54 declutched position when extension bar is fully 'in' or 'out'. Advantages are provided by the nut 40 and extension bar 26 motions that allow the catch 24 to be released or engaged. The catch 24 can be released or engaged without the addition of specific motor or the addition of complexive system as it can be released or engaged with relative displacement of nut 40 versus the extension bar 26. The door 10 is therefore maintained during the presenting motion and as long as user has not required the release, therefore door cannot hit the user. Another advantage of this actuator 14 is that the extension bar 26 is very thin, so that is can be set in vehicle with very small B/C pillar width (dimension X in FIG. 9) and it can also be fitted directly near the door shut face. FIG. 9 illustrates the door panel inner 22, the B or C pillar 16 and a door seal 84. The actuator 14 is secured to the door panel inner 22 via a feature or protrusion 86 on the actuator housing 30.

As such the door presenter 14 disclosed herein provides operation in which the vehicle door 10 is retained in the partially opened position or presented position, to prevent unintentional and/or uncontrolled moving of the vehicle door 10 to the fully open position by for example, a gust of wind or due to parking the vehicle on a slope or uneven surface.

The door presenter or actuator 14 of the present disclosure is contemplated for use with a handleless door. The actuator 14 may be independent or integrated into the latch 12 that is located inside the door. The actuator 14 will slightly rotate/open the door, enough that end user can insert his fingers to grab the door flange so that user can complete door opening manually. Another feature of the actuator 14 is that the actuator holds the door moved apart from the car body, in a 'presented' open position as the door 10 will then be maintained in 'presented' position, and it will not hit the user.

To perform the 'presenting' operation, the actuator 14 needs an additional dedicated striker 20 fitted onto the B or C pillar. As the actuator 14 is making a door presenting function (to move slowly the door from close to presented position), it needs to cooperate with a latch 12 that includes electrical release function and the actuator 14 is operable coupled to the latch 12 to obtain latch status information brought by sensors set within the latch 12.

As mentioned above, the actuator 14 described here is specifically designed to be as thin as possible in order to be fitted in narrow door where the door seal is very near from the shut face.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An actuator for presenting a handless door of a vehicle, the actuator comprising:

an extendable extension bar supporting a pawl/catch system, the pawl/catch system having an actuator catch that cooperates with a dedicated striker;

an actuator housing for housing a motor and a gear train operatively coupled to the motor, the gear train comprising a gear that has an integrated wormscrew;

a nut located on the integrated wormscrew that translates linearly on the wormscrew as it is rotated by the motor, wherein movement of the nut causes the extendable extension bar to be moved outwardly and inwardly from the housing and movement of the nut on the integrated wormscrew causes the nut to be coupled and decoupled to the extendable extension bar.

2. The actuator as in claim 1, wherein the extendable extension bar further comprises a pawl operably secured to the nut.

3. The actuator as in claim 2, wherein the pawl is slidably secured to a pawl and catch support received within a pair of covers of the extendable extension bar.

4. The actuator as in claim 3, the actuator catch is rotatably secured to the pawl and catch support.

5. The actuator as in claim 4, wherein the extendable extension bar further comprises a pawl and catch spring.

6. The actuator as in claim 1, further comprising a retainer pivotally mounted to the nut for coupling and decoupling the nut to the extendable extension bar, wherein the retainer is spring biased by a spring and wherein, when the nut is in contact with the extendable extension bar, a hook of the retainer engages a feature of the extendable extension bar.

7. The actuator as in claim 6, wherein the retainer also has a protrusion that slidably engages a declutching rib on a body of the actuator and wherein the protrusion engages an angled surface of the declutching rib so that the retainer can move in a direction opposite to a biasing force of the spring.

8. The actuator as in claim 7, wherein the declutching rib has a pair of angled surfaces.

9. A handless door of a vehicle, the handless door comprising:

a latch for securing the handless door to a striker; and an actuator mounted to an inner door trim of the handless door, comprising:

an extendable extension bar supporting a pawl/catch system, the pawl/catch system having an actuator catch that cooperates with a dedicated striker;

an actuator housing for housing a motor and a gear train operatively coupled to the motor, the gear train comprising a gear that has an integrated wormscrew;

a nut located on the integrated wormscrew that translates linearly on the wormscrew as it is rotated by the motor, wherein movement of the nut causes the extendable extension bar to be moved outwardly and inwardly from the housing and wherein outward movement of the extendable extension bar places the handless door in a presenting positon when the latch is disengaged and movement of the nut on the integrated wormscrew causes the nut to be coupled and decoupled to the extendable extension bar.

10. The handless door as in claim 9, wherein the extendable extension bar further comprises a pawl operably secured to the nut.

11. The handless door as in claim 10, wherein the pawl is slidably secured to a pawl and catch support received within a pair of covers of the extendable extension bar.

12. The handless door as in claim 11, the actuator catch is rotatably secured to the pawl and catch support.

13. The handless door as in claim 12, wherein the extendable extension bar further comprises a pawl and catch spring.

14. The handless door as in claim 9, further comprising a retainer pivotally mounted to the nut for coupling and decoupling the nut to the extendable extension bar, wherein the retainer is spring biased by a spring and wherein, when the nut is in contact with the extendable extension bar, a hook of the retainer engages a feature of the extendable extension bar.

15. The handless door as in claim 14, wherein the retainer also has a protrusion that slidably engages a declutching rib on a body of the actuator and wherein the protrusion engages an angled surface of the declutching rib so that the retainer can move in a direction opposite to a biasing force of the spring.

16. The handless door as in claim 15, wherein the declutching rib has a pair of angled surfaces.

17. A method for presenting a handless door, comprising:

locating an extendable extension bar of an actuator on an inner door panel of the handless door, the actuator supporting a pawl/catch system, the pawl/catch system having an actuator catch that cooperates with a dedicated striker;

extending and retracting the extendable extension bar with a nut located on an integrated worm screw of a gear train, wherein the nut translates linearly on the worm screw as it is rotated by a motor and movement of the nut on the integrated worm screw causes the nut to be coupled and decoupled to the extendable extension bar.

18. The method as in claim 17, wherein the actuator further comprises a retainer pivotally mounted to the nut, wherein the retainer is spring biased by a spring and wherein, when the nut is in contact with the extendable extension bar, a hook of the retainer engages a feature of the extendable extension bar.

19. The method as in claim 18, wherein the retainer also has a protrusion that slidably engages a declutching rib on a body of the actuator and wherein the protrusion engages an angled surface of the declutching rib so that the retainer can move in a direction opposite to a biasing force of the spring and wherein the declutching rib has a pair of angled surfaces.

20. An actuator for presenting a handless door of a vehicle, the actuator comprising:

an extendable extension bar supporting a pawl/catch system, the pawl/catch system having an actuator catch that cooperates with a dedicated striker;

a motor and a gear train operatively coupled to the motor, the gear train comprising a gear that has an integrated wormscrew;

a nut located on the integrated wormscrew that translates linearly on the wormscrew as it is rotated by the motor;

a retainer for coupling and decoupling the nut to the extendable extension bar; and wherein movement of the nut away from the extendable extension bar when the retainer decouples the nut from the extendable extension bar releases the actuator catch from the dedicated striker when the nut moves away from the extendable extension bar.

* * * * *